US007139010B2

(12) United States Patent
DeMeutter et al.

(10) Patent No.: US 7,139,010 B2
(45) Date of Patent: Nov. 21, 2006

(54) THERMAL HEAD PRINTER AND PROCESS FOR PRINTING SUBSTANTIALLY LIGHT-INSENSITIVE RECORDING MATERIALS

(75) Inventors: Stefaan DeMeutter, Antwerpen (BE); Eric Kaerts, Melsele (BE)

(73) Assignee: AGFA Gevaert, Mortsel (BE)

( * ) Notice: Subject to any disclaimer, the term of this patent is extended or adjusted under 35 U.S.C. 154(b) by 118 days.

(21) Appl. No.: 10/796,766

(22) Filed: Mar. 9, 2004

(65) Prior Publication Data

US 2004/0183887 A1 Sep. 23, 2004

Related U.S. Application Data

(60) Provisional application No. 60/459,657, filed on Apr. 2, 2003.

(30) Foreign Application Priority Data

Mar. 12, 2003 (EP) ..... 03100622

(51) Int. Cl.
*B41J 2/36* (2006.01)

(52) U.S. Cl. ..... 347/193

(58) Field of Classification Search ..... 347/188, 347/189, 190, 191, 192, 193
See application file for complete search history.

(56) References Cited

U.S. PATENT DOCUMENTS

| | | | | |
|---|---|---|---|---|
| 4,939,581 | A | 7/1990 | Shalit | |
| 5,469,203 | A * | 11/1995 | Hauschild | 347/190 |
| 5,528,275 | A | 6/1996 | Shinya et al. | |
| 5,711,621 | A | 1/1998 | Austin | |
| 5,796,420 | A * | 8/1998 | Kaerts et al. | 347/188 |
| 6,234,695 | B1 | 5/2001 | Freedman et al. | |
| 6,411,318 | B1 | 6/2002 | Sawano et al. | |
| 6,462,766 | B1 | 10/2002 | Roeber et al. | |
| 6,503,006 | B1 | 1/2003 | Freedman et al. | |
| 2001/0004284 | A1 | 6/2001 | Fukuda et al. | |
| 2002/0136582 | A1 | 9/2002 | Verdyck | |

FOREIGN PATENT DOCUMENTS

| | | | |
|---|---|---|---|
| EP | 0 453 714 | A1 | 10/1991 |
| EP | 0 922 585 | A2 | 6/1999 |
| EP | 1 006 404 | A1 | 6/2000 |
| EP | 1 247 654 | A1 | 10/2002 |
| JP | 2002 036610 | A | 2/2002 |

OTHER PUBLICATIONS

Search Report for EP 03 10 0622 (Aug. 6, 2003).

* cited by examiner

*Primary Examiner*—K. Feggins
(74) *Attorney, Agent, or Firm*—Leydig, Voit & Mayer, Ltd

(57) ABSTRACT

A thermal head printer with image-invariant printing speeds for printing a substantially light-insensitive thermographic material having a print density-driving power level characteristic, the thermal head printer comprising a transport means, one or more thermal heads each having an array of heating elements, a thermal print head drive system capable of supplying power to each of the printing elements, and a calibration means based on the print density-driving power level characteristic of the thermographic material; a process for calibrating a thermal head printer with image-invariant printing speeds, the thermal head printer comprising one or more thermal heads each having an array of heating elements connected to a power supply capable of supplying a given number of heating element driving power levels from 0 to a maximum driving power level number, corresponding to $P_{max}$, to each heating element for printing a substantially light-insensitive thermographic material by image-wise heating the thermographic material with the heating elements, the process comprising the steps of: (i) putting the printer into a calibration mode; (ii) printing one or more step-wedges of print densities by heating the thermographic material with the heating elements at different DPLN'S; (iii) determining the optical density of each step of the step-wedge(s) of print densities with a densitometer thereby obtaining the dependence of the print density upon DPLN; (iv) deriving from the dependence, or all the dependences of the print density upon DPLN, a single smoothed dependence of the rate of change of print density, D, with DPLN, ΔD/ΔDPLN, as a function of DPLN for the thermographic material; (v) establishing a threshold rate of print density change per DPLN for the specific thermographic material being printed; and (vi) setting up the thermal head printer so that the threshold rate of print density increase per DPLN cannot be undercut; and a process for printing a substantially light-insensitive thermographic material with a thermal head printer comprising one or more thermal heads each having an array of heating elements connected to a power supply capable of supplying a given number of heating element driving power levels from 0 to a maximum driving power level number, corresponding to $P_{max}$, the process comprising the steps of: calibrating the thermal head printer according to the above-described calibration process, transporting the substantially light-insensitive thermographic material past the thermal head, and image-wise heating of the substantially light-insensitive thermographic material by means of the heating elements.

16 Claims, 4 Drawing Sheets

THERMAL HEAD PRINTER AND PROCESS FOR PRINTING SUBSTANTIALLY LIGHT-INSENSITIVE RECORDING MATERIALS

CROSS-REFERENCE TO RELATED PATENT APPLICATIONS

This application claims the benefit of U.S. Provisional Application No. 60/459,657 filed Apr. 2, 2003, which is incorporated by reference. In addition, this application claims the benefit of European Application No. 03100622.4 filed Mar. 12, 2003, which is also incorporated by reference.

FIELD OF THE INVENTION

The present invention concerns a process for calibrating a thermal head printer for use with a substantially light-insensitive recording material.

BACKGROUND OF THE INVENTION

Thermography is an image-forming process including a heating step and hence includes photothermography in which the image-forming process includes image-wise exposure and direct thermal processes in which the image-forming process includes an image-wise heating step.

In direct thermal printing a visible image pattern is produced by image-wise heating of a recording material e.g. image signals can be converted into electric pulses and then via a driver circuit selectively transferred to a thermal head, which consists of microscopic heat resistor elements, thereby converting the electrical energy into heat via the Joule effect. This heat brings about image formation in the substantially light-insensitive thermographic material. In thermal heads, only those regions which produce heat higher than a certain value are effective for printing, and the regions capable of generating sufficient heat for the printing spread in proportion to voltage applied to the heating resistors. If, therefore, higher voltage is applied to the heating resistors, the size of the printing dots increases in proportion.

U.S. Pat. No. 6,462,766 discloses a method and an apparatus for limiting the peak power consumed by a thermal recorder connected to portable battery-powered equipment. The battery-powered equipment is designed with a filter and an electronic circuit breaker. A circuit breaker current sense resistor and an output capacitor form an RC filter and provide a large current reservoir for the thermal recorder which averages the peak current demands seen at the circuit input. The electronic circuit breaker provides a current limit function and will not allow a current greater than a predetermined amperage level to be drawn. The thermal recorder has a CPU which provides pulses to a thermal print head in dependence on data incorporated in a pulse-width limit table. The values in the pulse-width limit table can be substituted for calculated pulse widths that would produce peak currents large enough to trip the circuit breaker.

U.S. Pat. No. 6,234,695 discloses a printer using a power reduction logic based upon reducing the speed of printing when the dot utilization calculation exceeds a particular power level for that printer. There is also provided a method for printing information at a given power supply capacity level, comprising the steps of: examining the a group of rows of dots to be printed; calculating the maximum dot utilization value for the group; selecting a print speed based on the maximum dot utilization value; printing the first row of the group of rows; and repeating above steps until the information is printed.

U.S. Pat. No. 6,503,006 discloses a printer using a power reduction logic based upon reducing the speed of printing when the dot utilization calculation exceeds a particular power level for that printer. There is also provided a method for printing information at a given power supply capacity level, comprising the steps of: examining the a group of rows of dots to be printed; calculating the maximum dot utilization value for the group; selecting a print speed based on the maximum dot utilization value; printing the first row of the group of rows; and repeating above steps until the information is printed.

U.S. Pat. No. 5,528,275 discloses a gradational printing method for performing a gradational printing by energizing a plurality of heat emitting elements arranged on a thermal head correspondingly to respective bits of digital gradation data representing a gray level. In case of this method, the plurality of heat emitting elements are divided into two or more blocks and the blocks are energized correspondingly to different bits of the digital gradation data. Thus, an energizing time, during which a maximum current should be supplied, can be reduced.

EP-A 0 453 714 further discloses a gradation record printer in which an amount of energy applied to a thermal head is controlled in response to a gradation level of an image signal to print an image on a printing medium with gradations, said printer comprising: gradation density detecting means for storing data of standard density patterns with respect to address values corresponding to gradation levels, and for outputting a coincidence signal when data supplied from an outside of said gradation density detection means substantially coincides with said data of standard density patterns; a gradation test print circuit for applying data of different amounts of printing energy to said thermal head sequentially to make a gradation test print on said printing medium; density detecting sensor means for detecting densities of said gradation test print and for applying a detection output from said density detecting sensor means to said gradation density detection means; and a first memory element for storing said data of different amounts of energy with respect to address values corresponding to said gradation levels, in response to said coincidence signal from said gradation density detecting means.

EP-A 1 247 654 discloses that the traditional technique for calibrating a thermal printer is as follows: first, a first calibration page is printed with a limit setting to produce the desired maximum density and a full range of print settings. The next step is to determine whether this is the desired limit setting by visually inspecting the printed page. The normal objective is to find the minimum exposure required to print the full range of desired densities. The lower the limit setting, the more nearly continuous the grey scale in the printed film. The process of printing and adjusting the maximum limit setting is repeated until a desired limit setting is determined. Next, a second calibration page is printed with the limit system setting selected and with a subset of print system settings which cover the full range of print settings. The resulting densities of the printed page are then measured and a print setting to density table created for the full range of print settings. An output lookup table that can be used to set exposure to produce the desired density for any digital image value is created using the print setting to density table. Thereafter the thermal printer prints pages with this output lookup table to produce the desired densities while the same maximum exposure is appropriate.

EP-A 1 247 654 further discloses a method for calibrating a thermal printer comprising a thermal head incorporating a plurality of energisable heating elements, said method comprising the steps of: supplying to said thermal printer a thermographic material m, a plurality of printer data $P_i$ each intended to be recorded as a pixel having a density Di, and default reference values for printing parameters II comprising a value Pref for a reference printing power; printing a calibration pattern for said plurality of printer data $P_i$, said calibration pattern comprising a multiple step density wedge such that a whole range of a relation Di ($P_i$) between said printer data $P_i$ and said density Di is covered; measuring a density $Dexp_i$ for each patch of said density wedge of said calibration pattern in relation to said plurality of printer data $P_i$ and storing a first set S1=(Pref, $P_i$, $Dexp_i$) in a first memory M1; calculating, for a desired density $Dwant_j$, a corresponding value $Prefnew_j$ for said reference printing power and storing a second set S2=($Dwant_j$ $Prefnew_j$) in a second memory M2; calculating, for said desired density $Dwant_j$, for each printer data $P_i$ a corresponding density Di and storing a third set S3=($Dwant_j$, $Prefnew_j$, $P_i$, Di) in a third memory M3.

U.S. Pat. No. 5,711,621 discloses in a printer having a print region is defined by a thermal print head and a rotatable platen adapted to draw a print media therebetween, a method for calibrating the printer comprises the steps of: identifying a type of print media which is selected for use on said printer, wherein said selected type of print media has unknown printer parameter values; printing a series of test labels onto said selected type of print media using a parameter of said printer having a unique value for each individual one of said test labels of said series with identifying information of said unique parameter value being printed thereon; after printing said series of test labels, inspecting said series of test labels to select one of said test labels of said series having a desired level of image quality; and specifying said unique parameter value of said selected one of said test labels for further operation of said printer with said selected type of print media.

US 2001/004284 discloses a calibration pattern printing method for a printer that prints an image in an image recording area on a recording paper, comprising the steps of: printing a calibration pattern in a marginal area on the recording paper outside said image recording area; and cutting said marginal area with said calibration pattern off the recording paper after the image is printed in said image recording area.

Thermographic materials are increasingly being used for graphic arts, medical and other applications which require high maximum print densities. Attaining such high print densities in thermographic materials requires that the heating elements be driven at higher powers and hence to higher temperatures, which increases the probability of premature heating element failure due to overheating and of image faults in the thermographic materials due to overheating. A means is therefore required to avoid such failure of the heating elements due to overheating and to avoid such image faults in the thermographic materials without significant loss in maximum print density and significant loss in image information.

ASPECTS OF THE INVENTION

It is therefore an aspect of the present invention to provide a means to avoid failure of the heating elements due to overheating and to avoid such image faults in the thermographic materials due to overheating without significant loss in image information.

It is a further aspect of the present invention to provide a thermal head printer capable of printing a substantially light-insensitive thermographic material without unacceptable heating element failure and image faults in the thermographic materials due to overheating without significant loss in image information.

It is also an aspect of the present invention to provide a calibration process for printing a substantially light-insensitive thermographic material to avoid failure of the heating elements due to overheating and to avoid such image faults in the thermographic materials due to overheating without significant loss in image information during the printing of the thermographic material.

It is also an aspect of the present invention to provide a printing process for a substantially light-insensitive thermographic material which avoids heating element failure and image faults in the thermographic materials due to overheating without significant loss in image information.

Further aspects and advantages of the invention will become apparent from the description hereinafter.

SUMMARY OF THE INVENTION

Whereas prior art approaches have sought to avoid premature failure of the heating elements due to overheating and image faults in the thermographic materials due to overheating by reducing the printing speed, it has been surprisingly found that premature failure of the heating elements due to overheating and image faults in the thermographic materials due to overheating can be avoided without reducing the printing speed, i.e. with image-invariant printing speeds and hence invariant print throughput, by calibrating the drive characteristics of the heating elements for the specific thermographic material on the basis of the print density-driving power level characteristic of the thermographic material enabling printing quality independent of the thermal printing head conditions i.e. thermal printing head, installation variations and environmental conditions, all of which affect heat transfer from the heating elements to the thermographic material.

Aspects of the present invention are realized by a thermal head printer with image-invariant printing speeds for printing a substantially light-insensitive thermographic material having a print density-driving power level characteristic, the thermal head printer comprising a transport means, one or more thermal heads each having an array of heating elements, a thermal print head drive system capable of supplying power to each of the printing elements, and a calibration means based on the print density-driving power level characteristic of the thermographic material.

Aspects are also realised by a process for calibrating a thermal head printer with image-invariant printing speeds, the thermal head printer comprising one or more thermal heads each having an array of heating elements connected to a power supply capable of supplying a given number of heating element driving power levels from 0 to a maximum driving power level number, corresponding to $P_{max}$ to each heating element for printing a substantially light-insensitive thermographic material by image-wise heating the thermographic material with the heating elements, the process comprising the steps of: (i) putting the printer into a calibration mode; (ii) printing one or more step-wedges of print densities by heating the thermographic material with the heating elements at different DPLN's; (iii) determining the optical density of each step of the step-wedge(s) of print densities with a densitometer thereby obtaining the dependence of the print density upon DPLN; (iv) deriving from the dependence, or all the dependences of the print density upon DPLN, a single smoothed dependence of the rate of change of print density, D, with DPLN, ΔD/ΔDPLN, as a function of DPLN for the thermographic material; (v) establishing a threshold rate of print density change per DPLN for the specific thermographic material being printed; and (vi) setting up the thermal head printer so that the threshold rate of print density increase per DPLN cannot be undercut.

Aspects of the present invention are also realized by a process for printing a substantially light-insensitive thermographic material with a thermal head printer comprising one or more thermal heads each having an array of heating elements connected to a power supply capable of supplying a given number of heating element driving power levels from 0 to a maximum driving power level number, corresponding to $P_{max}$, the process comprising the steps of: calibrating the thermal head printer according to the above-described calibration process, transporting the substantially light-insensitive thermographic material past the thermal head, and image-wise heating of the substantially light-insensitive thermographic material by means of the heating elements.

Preferred embodiments of the present invention are disclosed in the detailed description of the invention.

DETAILED DESCRIPTION OF THE INVENTION

The present-invention will be described in greater detail in the following with reference to the accompanying drawings, wherein:

FIG. 1 shows the dependence of print density, D, represented by [D×100], upon driving power level number (DPLN) for maximum powers of 46.4 mW (curve 1) and 38.2 mW (curve 2) respectively for substantially light-insensitive thermographic material type 1.

FIG. 2 shows the dependencies of the slope of the dependence of print density (D) upon driving power level number (DPLN), ΔD/ΔDPLN, represented by [ΔD×100]/ΔDPLN, upon DPLN for the results of curve 1 and 2 of FIG. 1 in curves 3 and 4 respectively.

FIG. 3 shows the dependence of the maximum print density, $D_{max}$, represented by [$D_{max}$×100], upon the threshold rate of print density change with driving power level number Th i.e. threshold value of ΔD/ΔDPLN (curve 5), represented by [Th×100], and the corresponding maximum densities, represented by [$D_{max}$×100], without applying a threshold value of ΔD/ΔDPLN, Th (curve 6).

FIG. 4 shows the dependence of print density, D, represented by [D×100], upon driving power level number (DPLN) for maximum powers of 47.6 mW (curve 7), 44.6 mW (curve 8) and 41.7 mW (curve 9) respectively for substantially light-insensitive thermographic material type 2.

FIG. 5 shows the dependences of the slope of the dependence of print density (D) upon driving power level number (DPLN), ΔD/ΔDPLN, represented by [ΔD×100]/ΔDPLN, upon DPLN for the results of curves 7, 8 and 9 of FIG. 4 in curves 10, 11 and 12 respectively.

DEFINITIONS

Figure 1:
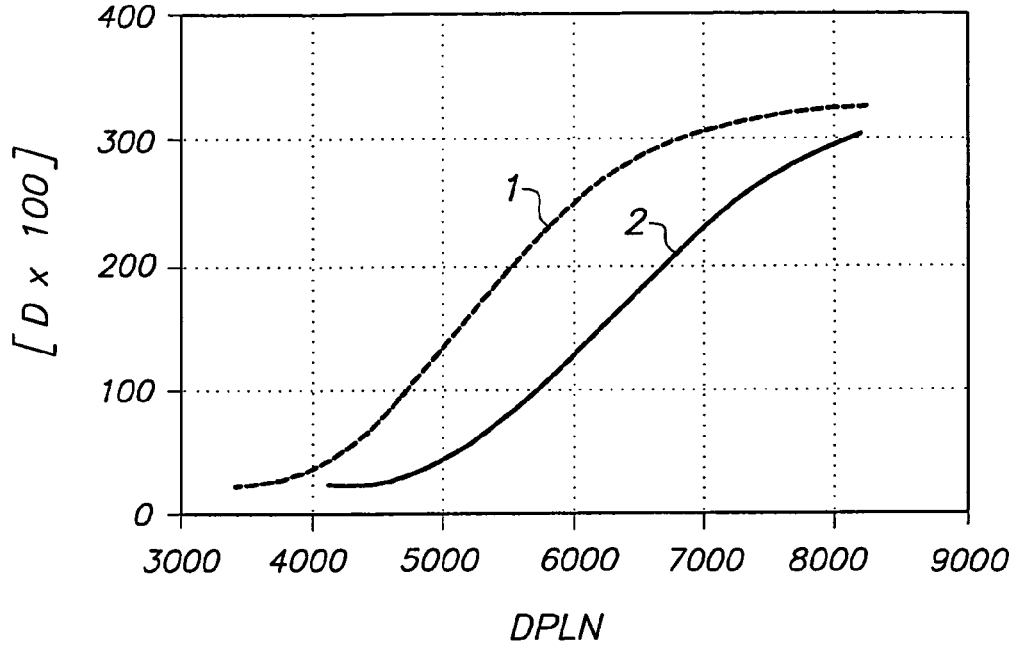

A heating element as used in disclosing the present invention is a resistor, which becomes hot upon being energized.

Transport speed, i.e. the speed of the substantially light-insensitive thermographic material, as used in disclosing the present invention, is the distance between adjacent lines of image dots in the transport direction divided by the line time.

Printing speed, as used in disclosing the present invention, is the speed at which the printing medium is transported through a printer.

The term "image-invariant printing speed", as used in disclosing the present invention, means that the image density has no influence upon the printing speed.

The term "dimensionless by normalization", as used in disclosing the present invention, means dividing a quantity by a reference value of that quantity e.g. the maximum value of that quantity which can be realized.

The term "single smoothed dependence of the rate of change of print density", as used in disclosing the present invention, means that all the measured values are represented by a dependence in the form of a smooth curve.

A transport means, as used in disclosing the present invention, can, for example, consist of a moving belt, a motor-driven drums, capstans or a combination thereof.

The print density-driving power level characteristic of a substantially light-insensitive thermographic recording material, according to the present invention, is the dependence of print density upon the driving power level of heating elements upon printing the thermographic material in the thermal head printer, according to the present invention.

According to the present invention, the available driving power range from 0 to a maximum driving power, $P_{max}$, is divided into a sufficient number of dimensionless i.e. normalized sub-units (the power increment between successive DPLN' being preferably constant) to enable the printing of sufficient grey tones to obtain prints without significant loss of imaging information, while providing the number of sub-units necessary to be able to achieve these grey tones with every heating element in the one or more thermal heads used in the printing process. These dimensionless sub-units are referred to as heating element driving power level numbers (DPLN') in disclosing the present invention. In the disclosure of the present invention DPLN will refer to the actual DPLN, if there is no variation in heating effect between the heating elements of the one or more thermal heads, or to the reference DPLN, if there is variation in heating effect between the heating elements of the one or more thermal heads.

The term "ΔD/ΔDPLN" is the rate of change of print density per heating element driving power level number.

The foot of the dependence of the print density upon DPLN is that part of the S-shaped print density upon DPLN dependence forming the bottom of the "S" and observed from the lowest DPLN at which an optical density above the background density Dmin is observed.

The shoulder of the dependence of the print density upon DPLN is that part of the S-shaped print density upon DPLN dependence forming the top of the "S" and ends with the maximum density $D_{max}$.

The threshold rate of change of print density per DPLN for the specific thermographic material being printed i.e. threshold ΔD/ΔDPLN, as used in disclosing the present invention, is that rate of change of print density per DPLN at an optical density level above the foot of the dependence of the print density upon DPLN, which corresponds to an acceptably high optical density, an acceptable level of information loss, an acceptable level of heating element failure and an acceptable level of damage to the thermographic material.

Substantially rectangular means having angles which deviate from 90° by no more than 20°.

Substantially light-insensitive means not intentionally light sensitive.

A leuco-dye is a colourless or weakly coloured compound derived from a dye. Colourless or light coloured dye precursor leuco-dye systems include leuco triarylmethane, indolyl phthalide, diphenylmethane, 2-anilinofluoran, 7-anilinofluoran, xanthene and spiro compounds such as disclosed in EP-A 754 564.

Thermal Head Printer

Aspects of the present invention are realized by a thermal head printer with image-invariant printing speeds for printing a substantially light-insensitive thermographic material having a print density-driving power level characteristic, the thermal head printer comprising a transport means, one or more thermal heads each having an array of heating elements, a thermal print head drive system capable of supplying power to each of the printing elements, and a calibration means based on the print density-driving power level characteristic of the thermographic material.

According to a first embodiment of the thermal head printer, according to the present invention, the maximum driving power applied to the thermographic material during the printing process is adjusted as a function of the print density-driving power level characteristic of the thermographic material.

According to a second embodiment of the thermal head printer, according to the present invention, the driving power level in the print density-driving power level characteristic of the thermographic material is rendered dimensionless by normalization.

According to a third embodiment of the thermal head printer, according to the present invention, the thermal head printer further comprises at least one densitometer capable of measuring the print density of a print produced with the thermal head printer.

According to a fourth embodiment of the thermal head printer, according to the present invention, the thermal print head drive system is capable of being calibrated by using the dependence of print density upon power supply level for the substantially light-insensitive thermographic material.

According to a fifth embodiment of the thermal head printer, according to the present invention, the thermal head printer is battery powered.

According to a sixth embodiment of the thermal head printer, according to the present invention, the thermal head printer is mains powered.

According to a seventh embodiment of the thermal head printer, according to the present invention, the thermal head printer has a single printing speed.

The calibration process according to the present invention excludes setting a maximum allowable temperature of a heating element.

Process for Calibrating a Thermal Head Printer

Aspects are realised by a process for calibrating a thermal head printer with image-invariant printing speeds, the thermal head printer comprising one or more thermal heads each having an array of heating elements connected to a power supply capable of supplying a given number of heating element driving power levels from 0 to a maximum driving power level number, corresponding to $P_{max}$, to each heating element for printing a substantially light-insensitive thermographic material by image-wise heating the thermographic material with the heating elements, the process comprising the steps of: (i) putting the printer into a calibration mode; (ii) printing one or more step-wedges of print densities by heating the thermographic material with the heating elements at different DPLN's; (iii) determining the optical density of each step of the step-wedge(s) of print densities with a densitometer thereby obtaining the dependence of the print density upon DPLN; (iv) deriving from the dependence, or all the dependences of the print density upon DPLN, a single smoothed dependence of the rate of change of print density, D, with DPLN, ΔDensity/ΔDPLN, as a function of DPLN for the thermographic material; (v) establishing a threshold rate of print density change per DPLN for the specific thermographic material being printed; and (vi) setting up the thermal head printer so that the threshold rate of print density increase per DPLN cannot be undercut.

The DPLN's for the printing of the step wedges can be default settings or these DPLN's can be determined from a reference print density-DPLN dependence obtained by determining the print density as a function of DPLN over the whole range of DPLN'. In the case of a variation in heating effect for a given DPLN between different heating elements in the one or more printing heads, each heating element exhibiting a different heating effect will exhibit a different dependence of print density upon DPLN which will be manifested as a variation in print density at each DPLN used. The data obtained by measuring this print density variation at each DPLN can be used to derive a reference print density-DPLN dependence, i.e. the reference DPLN required to obtain a particular print density, e.g. by plotting the average print density obtained at each DPLN versus DPLN. This can be used to determine the reference print density-DPLN dependence i.e. the reference DPLN's necessary to realize a particular density.

According to a first embodiment of the process for calibrating a thermal head printer, according to the present invention step (ii) is preceded by a determination of the dependence of print density upon DPLN i.e. the reference print density-DPLN dependence for the particular thermographic material.

If there is a difference in heating effect at a given DPLN between different heating elements in the one or more printing heads, a compensation procedure is necessary to determine the print-density-DPLN characteristic for each heating element. In practice it is not necessary to determine experimentally the DPLN necessary to realize every grey tone with each heating element, it being sufficient to determine the DPLN's required for each heating element required to achieve a particular print density e.g. a print density of 1.0. The DPLN's required to obtain this reference density for each heating element can be represented as percentage changes in DPLN with respect to the reference DPLN obtained from the reference print density-DPLN dependence. It has been experimentally established that these percentage changes in DLPN with respect to the reference DPLN are practically independent of print density for the print density range within which image information is to be found. Therefore the look-up tables of DPLN's required to obtain a particular print density for each heating element can be drawn up, which are valid until the following compensation procedure is carried out. In practice this compensation procedure is carried out a regular time intervals during printer operation, so that this look-up table is constantly varying as the printing environment changes e.g. as the thermal heads heat up during extended use. This procedure is described, for example, in EP-A 1 247 654, herein incorporated by reference.

Calibration of the drive characteristics of the heating elements for the specific thermographic material being printed independent of the thermal printing head conditions i.e. thermal printing head, installation variations and environmental conditions, is achieved, according to the present invention, by normalizing the print density-driving power characteristic by dividing the available driving power range from 0 to a maximum driving power level number, corresponding to $P_{max}$, into a given number of power levels (DPLN'), printing a step-wedge at predetermined DPLN', measuring the print density at each of the predetermined DPLN', differentiating the resulting print density-DPLN characteristic, establishing a threshold rate of change of print density per driving power, Th, for the specific thermographic material being printed i.e. the threshold value of ΔD/ΔDPLN, and then setting the thermal head printer so that the thermal printing head is driven in such a way that the rate of change of print density per driving power level does not undercut the threshold rate of print density per DPLN i.e. the threshold value of ΔD/ΔDPLN.

According to a second embodiment of the process for calibrating a thermal head printer, according to the present invention, the threshold rate of print density change per DPLN is in the shoulder of the S-shaped print density upon DPLN dependence.

According to a third embodiment of the process for calibrating a thermal head printer, according to the present invention, the one or more step wedges of print densities are printed simultaneously i.e. substantially at an angle of 90° to the transport direction and substantially parallel to the thermal head or thermal heads.

According to a fourth embodiment of the process for calibrating a thermal head printer, according to the present invention, steps (i) to (iii) are repeated at different places on the thermographic material to obtain further dependencies of the print density upon the heat produced by the heating elements for the thermographic material.

According to a fifth embodiment of the process for calibrating a thermal head printer, according to the present invention, the step-wedges of print densities are printed in the transport direction.

The threshold rate of change of print density per DPLN for the specific thermographic material being printed (threshold slope) can, for example, be established by first determining the print density at which the highest rate of print density per DPLN is observed, then determining the dependence of print density upon the rate of change of print density per DPLN for print densities higher than that corresponding to the maximum rate of change of print density per DPLN and selecting a DPLN, the critical DPLN, at which an acceptable rate of heating element failure and an acceptable rate of damage of the thermographic material is observed and at which there is an insignificant loss of imaging information. This last criterion means that the critical DPLN will be in the shoulder of the "S"-shaped dependence of print density upon DPLN. A type of damage to thermographic materials frequently observed is the appearance of pinholes and hence a possible criterion with respect to thermographic material damage can be the incidence of pinholes as shown in INVENTION EXAMPLE 1. A possible measure of the failure rate of heating elements could be the drift in heating element heating characteristics, which could be obtained from the above-mentioned compensation procedure data. The rate of change of print density per DPLN corresponding to this critical DPLN i.e. the threshold rate of change of print density per DPLN, Th, is the threshold ΔD/ΔDPLN value below which unacceptable printing conditions obtain.

The print density-DPLN characteristics are determined by printing an array of areas of the thermographic material, each area being printed with heating elements each supplied with the power to give the same grey level response, these areas being sufficiently large to enable the print density to be determined by a densitometer, preferably being wide enough to enable sufficient densitometric measurements to be carried out that a reliable and consistent print density value can be established by taking the average of values left after rejecting measurements which vary by more than a predetermined percentage from the average print density value. These areas may form an array substantially parallel to the printing head or printing heads or form an array in the transport direction of the printer. If more than one print density-DPLN characteristic is combined to produce a master characteristic, the print density-DPLN characteristic used can be generated at the same or different power level numbers. If the heating effect of the heating elements varies from heating element to heating element, the DPLN value in the above-mentioned print density-DPLN characteristics will be the reference DPLN value.

The delay between printing and optical density measurement should be as constant as possible to allow for print density variation subsequent to printing.

According to a sixth embodiment of the process for calibrating a thermal head printer, according to the present invention, there is a predetermined delay-time between printing of an area with the same grey level and measuring the print density thereof e.g. 50 s.

According to a seventh embodiment of the process for calibrating a thermal head printer, according to the present invention, the densitometric measurements are performed on the array or arrays of areas with different print densities corresponding to different DPLN's with one or more static densitometers while the thermographic material is transported under the densitometer head(s). This can be on-line with or without stopping the transport of the thermographic material between the printing and the densitometric measurements or off-line. If performed on-line without stopping the transport of thermographic material, the delay after printing is the transport time between the thermal head and the densitometer head i.e. the quotient of the distance between the thermal head and the densitometer head and the transport speed.

According to an eighth embodiment of the process for calibrating a thermal head printer, according to the present invention, the densitometric measurements are performed with the thermographic material stationary and with one or more dynamic densitometers scanning over the array or arrays of areas with different print densities corresponding to different DPLN's or different reference DPLN's. Such measurements can be carried out on-line i.e. in the printer itself by stopping the transport of the thermographic material and scanning the array or arrays of areas with different print densities corresponding to different DPLN's or reference DPLN's, or off-line. If dynamic densitometry is used, it is preferred that the array or arrays of areas with different print densities corresponding to different DPLN's or reference DPLN's be printed substantially parallel to the thermal head or thermal heads and that the one or more dynamic densitometers scan in a direction substantially parallel to the thermal head or thermal heads.

Since the thermographic material may vary in its thermal response over the area thereof, it is advantageous to combine data obtained from different areas of the thermographic material e.g. by combining print density-DPLN or reference DPLN characteristics from different areas of the thermographic material. These arrays of printed areas can be substantially at 90° to or substantially parallel to the transport direction of the thermographic material. If print density-DPLN or reference DPLN data from different areas of the thermographic material with slightly different thermal response characteristics are combined into a master curve before differentiating to obtain the rate of print density per DPLN as a function of DPLN, prior smoothing of the raw print density-DPLN or reference DPLN data is preferred. Any of the standard smoothing procedures may be used, but the floating point method is preferred.

The width of the area traversed by the densitometer should be sufficient to enable multiple densitometric measurements to be carried out and will depend upon the scanning speed of the densitometer, if it is dynamic, the transport speed of the thermographic material, if it is moving, the available light intensity, the spot size, the degree of overlap from measurement to measurement and the measurement rate of the densitometer. These factors will also determine the number of areas that can be printed. If several print density-DPLN or reference DPLN characteristics are used to yield a master curve, as few as eight points per characteristic has been found to be sufficient to yield a reliable master curve after smoothing.

The densitometer can be a transmission or reflection densitometer depending if the thermographic material is transparent, but only a reflection densitometer if the thermographic material is opaque.

Process for Printing a Substantially Light-insensitive Thermographic Material Aspects of the present invention are realized by a process for printing a substantially light-insensitive thermographic material with a thermal head printer comprising one or more thermal heads each having an array of heating elements connected to a power supply capable of supplying a given number of heating element driving power levels from 0 to a maximum driving power level number, corresponding to $P_{max}$, the process comprising the steps of: calibrating the thermal head printer according to the above-described calibration process, transporting the substantially light-insensitive thermographic material past the thermal head, and image-wise heating of the substantially light-insensitive thermographic material by the driving power levels to the heating elements.

The operating temperature of common thermal heads is in the range of 300° to 400° C. and the pressure contact of the thermal printhead with the recording material to ensure a good transfer of heat being e.g. 200–100 g/linear cm i.e. with a contact zone (nip) of 200 to 300 μm a pressure of 5000 to 50,000 g/cm$^2$. Activation of the heating elements can be power-modulated or pulse-length modulated at constant power.

Substantially Light-Insensitive Thermographic Material

The term substantially light-insensitive thermographic material includes all materials which produce a change in optical density upon the application of heat.

According to a first embodiment of the process for printing a substantially light-insensitive thermographic material and a seventh embodiment of the process for calibrating a thermal head printer, according to the present invention, the substantially light-insensitive thermographic material is a black and white material.

According to a second embodiment of the process for printing a substantially light-insensitive thermographic material and an eighth embodiment of the process for calibrating a thermal head printer, according to the present invention, the substantially light-insensitive thermographic material is a two sheet material in which an ingredient necessary for the image-forming process is transferred upon image-wise application of heat from one sheet to the other where it reacts with one or more further ingredients to produce an image.

According to a third embodiment of the process for printing a substantially light-insensitive thermographic material and a ninth embodiment of the process for calibrating a thermal head printer, according to the present invention, the substantially light-insensitive thermographic material is a monosheet material.

According to a fourth embodiment of the process for printing a substantially light-insensitive thermographic material and a tenth embodiment of the process for calibrating a thermal head printer, according to the present invention, the substantially light-insensitive thermographic material contains a thermosensitive element comprising one or more layer, the one or more layers containing an image-forming system.

Suitable image-forming systems include monosheet substantially light-insensitive thermographic materials such as colourless or light coloured dye precursor leuco-dye systems, as disclosed in U.S. Pat. No. 4,370,370, EP-A 479 578 and EP-A 754 564, diazo systems, as disclosed in JP 60-01077A, or two-sheet thermal dye transfer systems, such as disclosed in EP-A 656 264 and U.S. Pat. No. 4,943,555. Alternatively the image-forming systems may comprise at least one substantially light-insensitive organic silver salt and at least one organic reducing agent therefor either in a two-sheet material in which upon image-wise application of heat at least one organic reducing agent is image-wise transferred to a sheet containing the at least one substantially light-insensitive organic silver salt whereupon the image-forming reaction takes place or in a monosheet material in which the at least one substantially light-insensitive organic silver salt is in thermal working relationship with the at least one organic reducing agent therefor.

According to a fifth embodiment of the process for printing a substantially light-insensitive thermographic material and an eleventh embodiment of the-process for calibrating a thermal head printer, according to the present invention, the substantially light-insensitive thermographic material is a monosheet material comprising a thermosensitive element and a support, the thermosensitive element comprising at least one substantially light-insensitive organic silver salt, at least one organic reducing agent therefor in thermal working relationship therewith, i.e. during the thermal development process the organic reducing agent must be present in such a way that it is able to diffuse to the substantially light-insensitive organic silver salt particles so that reduction of the substantially light-insensitive organic silver salt can take place, and a binder. Such materials include the possibility of one or more substantially light-insensitive organic silver salts and/or one of more organic reducing agents therefor being encapsulated in heat-responsive microcapsules, such as disclosed in EP-A 0 736 799 herein incorporated by reference.

All substantially light-insensitive thermographic materials exhibit a print density-driving power characteristic, which has a weak print density-driving power response at very low driving powers, a strong print density-driving power response to low to high driving powers and a weak print density-driving power response at very high driving powers, which may even become negative at extremely high driving powers due to image defects such as pin-holes. A balance has to be struck in thermographic materials between shelf-life stability and thermosensitivity, which means that, if very high print densities are required, the maximum density required is often to be found in the weak print density-driving power response at very high driving powers.

Organic Silver Salts

Preferred substantially light-insensitive organic silver salts for use in the thermosensitive element of the substantially light-insensitive elongated imaging material used in the present invention, are silver salts of aliphatic carboxylic acids known as fatty acids, wherein the aliphatic carbon chain has preferably at least 12 C-atoms, which silver salts are also called silver soaps.

Organic Reducing Agents

Suitable organic reducing agents for the reduction of the substantially light-insensitive organic silver salts are organic compounds containing at least one active hydrogen atom linked to O, N or C. The choice of reducing agent influences the thermal sensitivity of the imaging material and the gradation of the image. Imaging materials using gallates, for example, have a high gradation. In a preferred embodiment of the present invention the thermosensitive element contains a 3,4-dihydroxyphenyl compound with ethyl 3,4-dihydroxybenzoate, n-butyl 3,4-dihydroxybenzoate, 3,4-dihydroxy-benzophenone and 3,4-dihydroxy-benzonitrile being particularly preferred.

Binder

The thermosensitive element of the substantially light-insensitive elongated imaging material used in the present invention may be coated onto a support in sheet- or web-form from an organic solvent containing the binder dissolved therein or may be applied from an aqueous medium using water-soluble or water-dispersible binders.

Suitable binders for coating from an organic solvent are all kinds of natural, modified natural or synthetic resins or mixtures of such resins, wherein the organic heavy metal salt can be dispersed homogeneously or mixtures thereof.

Suitable water-soluble film-forming binders include: polyvinyl alcohol, polyacrylamide, polymethacrylamide, polyacrylic acid, polymethacrylic acid, polyethyleneglycol, polyvinylpyrrolidone, proteinaceous binders such as gelatin and modified gelatins, such as phthaloyl gelatin, polysaccharides, such as starch, gum arabic and dextrin, and water-soluble cellulose derivatives. Suitable water-dispersible binders are any water-insoluble polymers. Poly(vinylbutyral) is the preferred binder.

In the case of substantially light-insensitive thermographic materials containing substantially light-insensitive organic silver salts, the binder to organic silver salt weight ratio decreases the gradation of the image increasing. Binder to organic silver salt weight ratios of 0.2 to 6 are preferred with weight ratios between 0.5 and 3 being particularly preferred.

The above mentioned binders or mixtures thereof may be used in conjunction with waxes or "heat solvents" to improve the reaction speed of the image-forming reaction at elevated temperatures.

Toning Agents

In order to obtain a neutral black image tone in the higher densities and neutral grey in the lower densities, the substantially light-insensitive thermographic material used in the present invention may contain one or more toning agents. In the case of substantially light-insensitive thermographic materials containing substantially light-insensitive organic silver salts, the toning agents should be in thermal working relationship with the substantially light-insensitive organic silver salt and reducing agents during thermal processing.

Suitable toning agents are described in U.S. Pat. Nos. 3,074,809, 3,446,648 and 3,844,797 and useful toning agents are the heterocyclic toning compounds of the benzoxazine dione or naphthoxazine dione type as disclosed in GB 1,439,478, U.S. Pat. No. 3,951,660 and U.S. Pat. No. 5,599,647.

According to an seventh embodiment of the process, according to the present invention, the substantially light-insensitive thermographic material contains a thermosensitive element, the thermosensitive element containing one or more toning agents selected from the group consisting of phthalazinone, benzo[e][1,3]oxazine-2,4-dione, 7-methyl-benzo[e][1,3]oxazine-2,4-dione, 7-methoxy-benzo[e][1,3]oxazine-2,4-dione and 7-(ethylcarbonato)-benzo[e][1,3]oxazine-2,4-dione.

Stabilizers and Antifoggants

In order to obtain improved shelf-life, archivability and reduced fogging, stabilizers and antifoggants may be incorporated into the substantially light-insensitive thermographic material used in the present invention. Suitable stabilizers compounds for use in the substantially light-insensitive thermographic material used in the present invention include benzotriazole, tetrachlorophthalic acid anhydride and those compounds represented by general formula I:

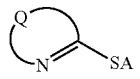

(I)

where Q are the necessary atoms to form a 5- or 6-membered aromatic heterocyclic ring, A is selected from hydrogen, a counterion to compensate the negative charge of the thiolate group or a group forming a symmetrical or an asymmetrical disulfide.

Surfactants and Dispersants

Surfactants and dispersants aid the dispersion of ingredients which are insoluble in the particular dispersion medium. The substantially light-insensitive thermographic material used in the present invention may contain one or more surfactants, which may be anionic, non-ionic or cationic surfactants and/or one or more dispersants. Suitable dispersants are natural polymeric substances, synthetic polymeric substances and finely divided powders, e.g. finely divided non-metallic inorganic powders such as silica.

Support

According to a eighth embodiment of the processes, according to the present invention, the substantially light-insensitive thermographic material has a transparent or translucent support and is preferably a thin flexible carrier made transparent resin film, e.g. made of a cellulose ester, e.g. cellulose triacetate, polypropylene, polycarbonate or polyester, e.g. polyethylene terephthalate. The support may be in sheet, ribbon or web form and subbed if needs be to improve the adherence to the thereon coated thermosensitive element. The support may be dyed or pigmented to provide a transparent coloured background for the image.

Protective Layer

In a preferred embodiment of the present invention a protective layer is provided for the thermosensitive element. In general this protects the thermosensitive element from atmospheric humidity and from surface damage by scratching etc. and prevents direct contact of printheads or other heat sources with the recording layers. Protective layers for thermosensitive elements which come into contact with and have to be transported past a heat source under pressure, have to exhibit resistance to local deformation and good slipping characteristics during transport past the heat source during heating. A slipping layer, being the outermost layer, may comprise a dissolved lubricating material and/or particulate material, e.g. talc particles, optionally protruding from the outermost layer. Examples of suitable lubricating materials are a surface active agent, a liquid lubricant, a solid lubricant or mixtures thereof, with or without a polymeric binder.

Coating Techniques

The coating of any layer of the substantially light-insensitive thermographic material used in the present invention may proceed by any coating technique e.g. such as described in Modern Coating and Drying Technology, edited by Edward D. Cohen and Edgar B. Gutoff, (1992) VCH Publishers Inc., 220 East 23rd Street, Suite 909 New York, N.Y. 10010, USA. Coating may proceed from aqueous or solvent media with overcoating of dried, partially dried or undried layers.

The invention is illustrated hereinafter by way of comparative examples and invention examples. The percentages and ratios given in these examples are by weight unless otherwise indicated.

EXAMPLES

Preparation of Type 1 and Type 2 Substantially Light-insensitive Thermographic Materials Type 1 and type 2 substantially light-insensitive thermographic materials were prepared by coating a 175 μm thick blue-pigmented poly(ethylene terephthalate) support with a subbing layer with the following composition:

| | |
|---|---|
| copolymer of 88% vinylidene chloride, 10% methyl acrylate and 2% itaconic acid | 79.1 mg/m$^2$ |
| Kieselsol ® 100 F, a colloidal silica from BAYER | 18.6 mg/m$^2$ |
| Mersolat ® H, a surfactant from BAYER | 0.4 mg/m$^2$ |
| Ultravon ® W, a surfactant from CIBA-GEIGY | 1.9 mg/m$^2$ |

This subbing layer was then coated with thermosensitive element types 1 and 2 respectively as given below from coating dispersions in 2-butanone to a coating thickness of 100 μm:

| | Thermosensitive element types | |
|---|---|---|
| | 1 [g/m$^2$] | 2 [g/m$^2$] |
| silver behenate | 4.40 | 4.42 |
| S-LEC BL5HP, a polyvinyl butyral from SEKISUI | 17.60 | 16.79 |
| 3,4-dihydroxybenzonitrile | 0.394 | 0.618 |
| ethyl 3,4-dihydroxybenzoate | 0.866 | 0.515 |
| 7-(ethylcarbonato)-benzo [e] [1,3] oxazine-2,4-dione | 0.124 | 0.226 |
| 7-methyl-benzo [e] [1,3] oxazine-2,4-dione | 0.261 | — |
| glutaric acid | 0.312 | 0.287 |
| tetrachlorophthalic acid anhydride | 0.139 | 0.139 |
| benzotriazole | 0.115 | 0.116 |
| BAYSILON, a silicone oil from BAYER | 0.039 | 0.039 |

The thermosensitive elements were then further coated with an aqueous composition with the following ingredients, which was adjusted to a pH of 3.8 with lN nitric acid, to a wet layer thickness of 85 μm and then dried at 50° C. for 15 minutes to produce a protective layer with the composition:

| | [g/m$^2$] |
|---|---|
| ERCOL ™ 48 20, a polyvinylalcohol from ACETEX EUROPE | 2.1 |
| LEVASIL ™ VP AC 4055, a 15% aqueous dispersion of colloidal silica with acid groups predominantly neutralized with sodium ions and a specific surface area of 500 m$^2$/g from BAYER AG, which has been converted into the ammonium salt | 1.05 |
| ULTRAVON ™ W, a 75–85% concentrate of a sodium arylsulfonate from Ciba Geigy converted into acid form by passing through an ion exchange column | 0.075 |
| SYLOID ™ 72, a silica from Grace | 0.09 |
| SERVOXYL ™ VPDZ 3/100, a mono[isotridecyl polyglycolether (3 EO)] phosphate from SERVO DELDEN B.V. | 0.075 |
| SERVOXYL ™ VPAZ 100, a mixture of monolauryl and dilauryl phosphate from SERVO DELDEN B.V. | 0.075 |
| MICROACE TALC P3, an Indian talc from NIPPON TALC | 0.045 |
| RILANIT ™ GMS, a glycerine monotallow acid ester from HENKEL | 0.15 |
| TMOS tetramethylorthosilicate hydrolyzed in the presence of methanesulfonic acid | 0.87* |

*assuming that the TMOS was completely converted to $SiO_2$

After coating the protective layer was hardened by heating the substantially light-insensitive thermographic material at 45° C. for 7 days at a relative humidity of 70%.

INVENTION EXAMPLE 1

Figure 2:
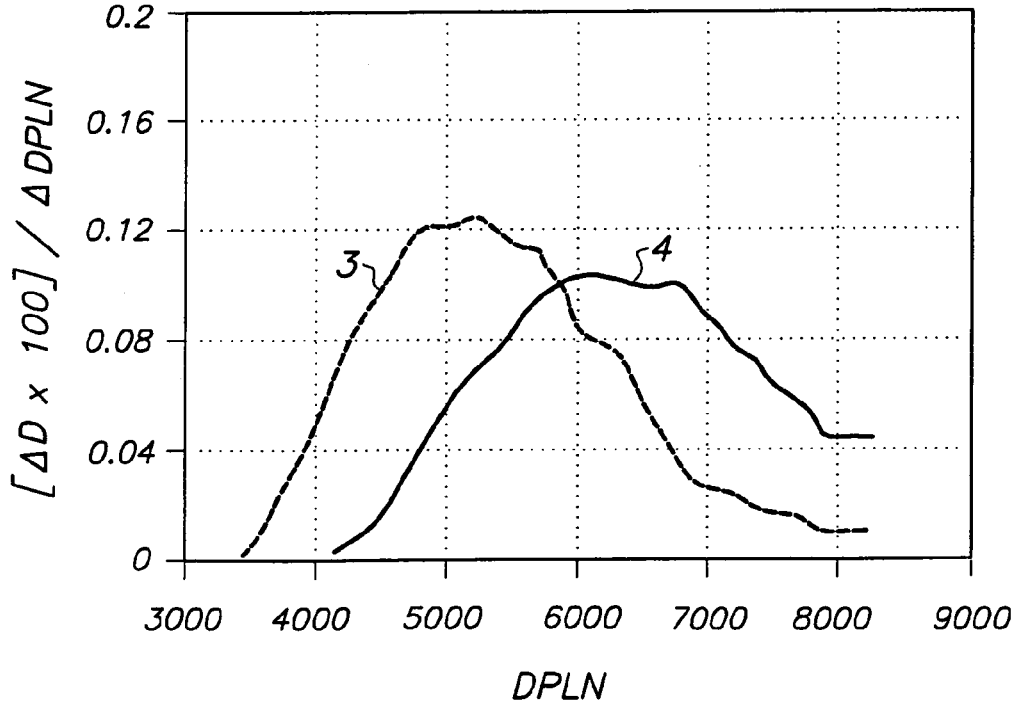

Four step-wedges were simultaneously printed with the type 1 substantially light-insensitive thermographic material in an environment with a temperature of 25° C. and a relative humidity of 50% relative humidity with a DRYSTAR™ 4500 M printer with a line time of 7 ms from AGFA-GEVAERT N.V. consisting each of 13 areas 4 mm in width and ca. 200 mm in length along the transport direction of the printer with a maximum power level of 38.2 mW. Each of the 52 areas was printed at a different DPLN from a total number of 13 bit (8192) with each of the 13 areas covering the whole DPLN range. The optical densities were measured with a built in dynamic transmission densitometer with a spot size of 0.6 mm by taking the average of 10 measurements. The densitometer scanned over the areas at substantially 90° to the transport direction with the substantially light-insensitive thermographic material stationary. The four sets of print density-DPLN data were combined into a single smoothed master curve, see curve 1 of FIG. 1, in which [D×100] is plotted against DPLN, and the slope, ΔD/ΔDPLN, calculated as a function of DPLN, see curve 3 of FIG. 2, in which [ΔD×100]/ΔDPLN is plotted against DPLN. This experiment was then repeated with a maximum power level of 46.4 mW, see curve 2 of FIG. 1 and curve 4 of FIG. 2 respectively.

Figure 3:
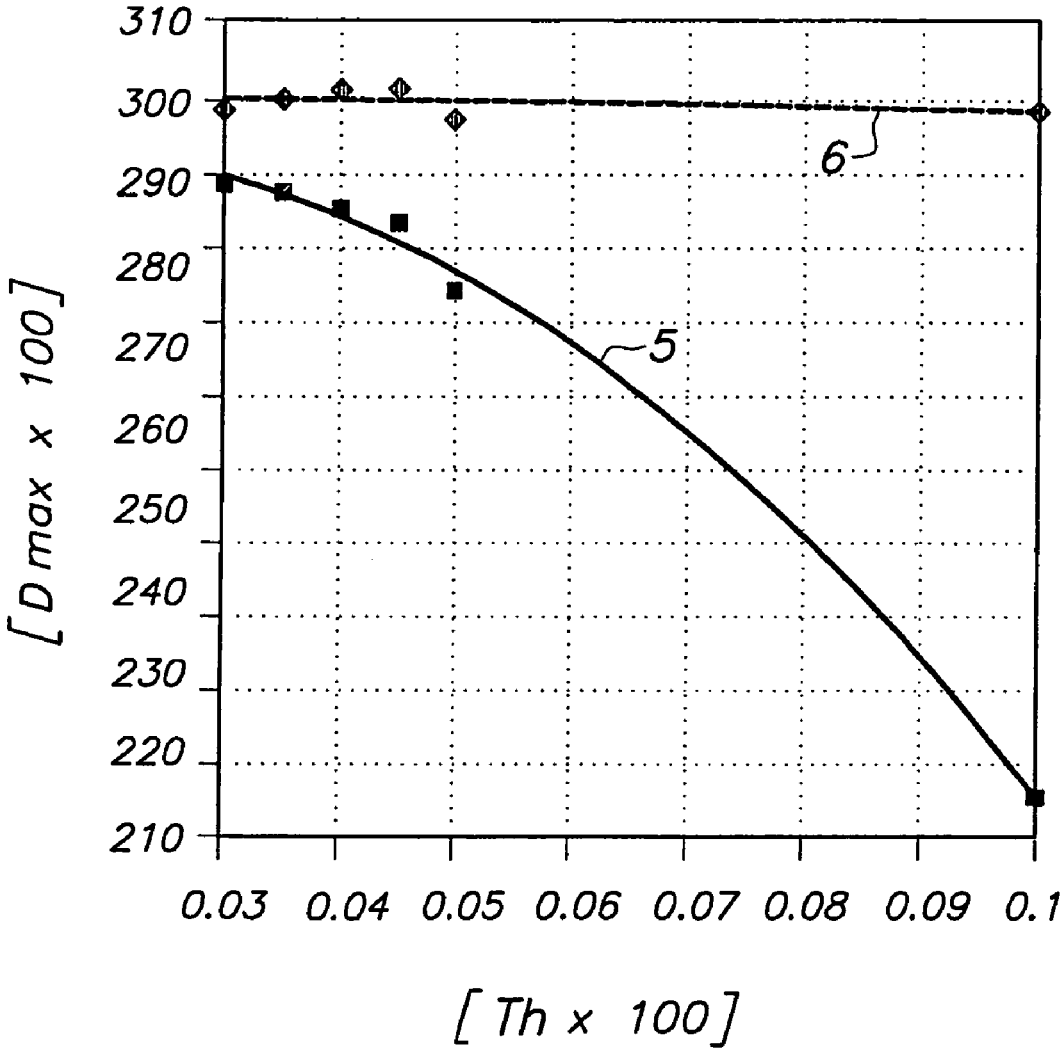

Curve 5 of FIG. 3, in which [$D_{max}$×100] is plotted against [Th×100], shows the influence of increasing the threshold value of print density change with DPLN, Th, i.e. the threshold ΔD/ΔDPLN value, from 0.0003 to 0.0010 upon the maximum print density $D_{max}$ upon printing in an environment with a temperature of 30° C. and 80% relative humidity i.e. more critical conditions for print quality. Table 1 provides the maximum print density values $D_{max}$ obtained with different threshold slopes and the incidence of pin-holes. The incidence of pin-holes was assessed as follows:

pin-hole assessment 0 = no pin-holes observable
pin-hole assessment 1 = occasional pin-hole barely observable
pin-hole assessment 2 = a few pin-holes, difficult to see
pin-hole assessment 3 = moderate number of pin-holes
pin-hole assessment 4 = large number of pin-holes
pin-hole assessment 5 = very large number of pin-holes A threshold slope setting of 0.00045 represented an acceptable compromise between acceptable $D_{max}$ reduction of 0.15 together with an acceptable level of pin-holes.

TABLE 1

| Dmax without threshold slope setting | Threshold slope, Th | $D_{max}$ with threshold slope setting | Assessment of pinholes |
|---|---|---|---|
| 2.99 | 0.0003 | 2.90 | 4 |
| 3.00 | 0.00035 | 2.89 | 4 |
| 3.01 | 0.0004 | 2.87 | 3 |
| 3.01 | 0.00045 | 2.85 | 2 |
| 2.98 | 0.0005 | 2.77 | 1 |
| 2.99 | 0.001 | 2.15 | 0 |

INVENTION EXAMPLE 2

Four step-wedges were simultaneously printed with the type 2 substantially light-insensitive thermographic material in an environment with a temperature of 25° C. and a relative humidity of 50% relative humidity with a DRYSTAR™ 4500 printer with a line time of 7 ms from AGFA-GEVAERT N.V. consisting each of 13 areas 4 mm in width and ca. 200 mm in length along the transport direction of the printer with a maximum power level of 47.6 mW. Each of the 52 areas was printed at a different DPLN from a total number of 13 bit (8192) with each of the 13 areas covering the whole DPLN range. The optical densities were measured with a built in dynamic transmission densitometer with a spot size of 0.6 mm by taking the average of 10 measurements. The densitometer scanned over the areas at an angle of substantially 90° to the transport direction with the substantially light-insensitive thermographic material stationary. The four sets of print density-DPLN data were combined into a single smoothed master curve, see curve 7 of FIG. 4, in which [D×100]is plotted against DPLN, and the slope calculated as a function of DPLN, see curve 10 of FIG. 5, in which [ΔD×100]/ΔDPLN is plotted against DPLN. This experiment was then repeated with maximum power levels of 44.6 mW (see curve 8 of FIG. 4 and curve 11 of FIG. 5 respectively) and 41.7 mW (see curve 9 of FIG. 4 and curve 12 of FIG. 5 respectively).

Figure 4:
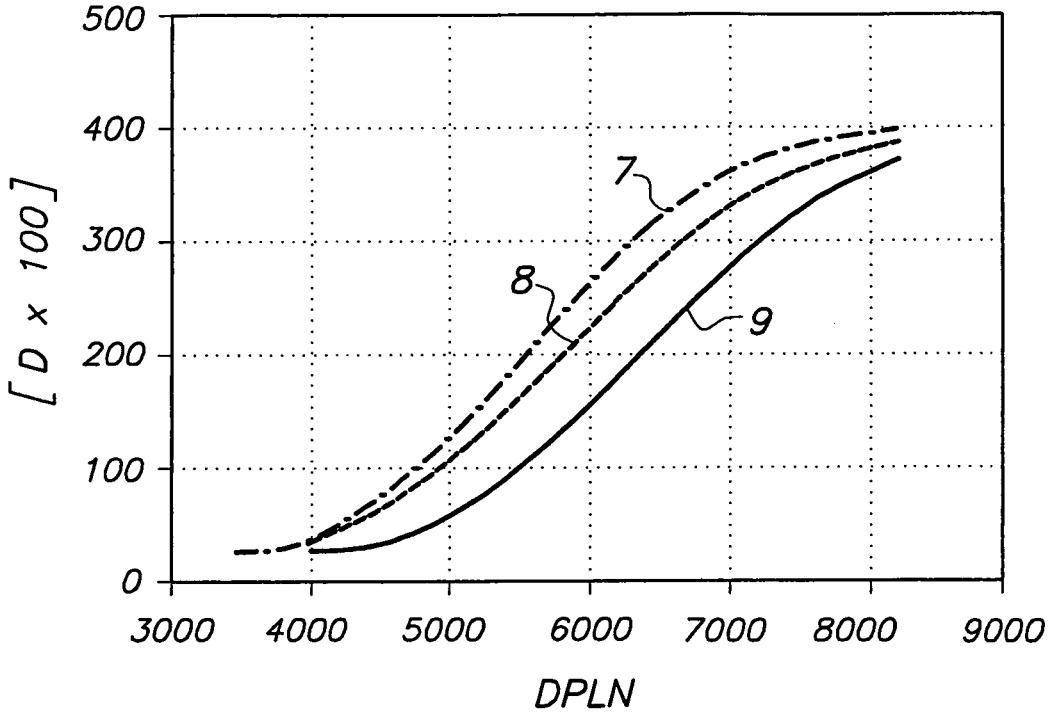
Figure 5:
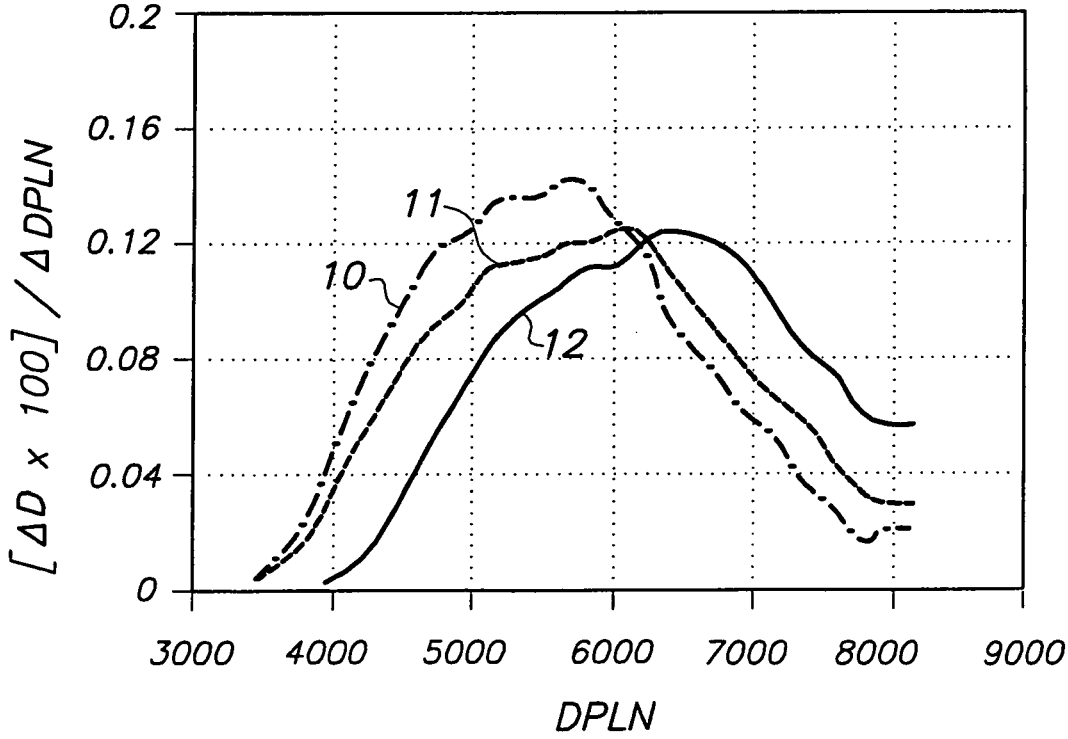

FIG. 5 shows the dependencies of the slope of the dependence of print density (D) upon DPLN, ΔD/ΔDPLN, represented by [ΔD×100]/ΔDPLN, upon DPLN for the results of curves 7, 8 and 9 of FIG. 4 in curves 10, 11 and 12 respectively.

Printing experiments in an environment with a temperature of 30° C. and 80% relative humidity using a threshold slope setting of 0.045 enabled a $D_{max}$ of 3.70 to be realized without observation of pinholes in the thermographic material, i.e. with a pinhole assessment of 0, and without significant loss of image information.

INVENTION EXAMPLE 3

Figure 6:
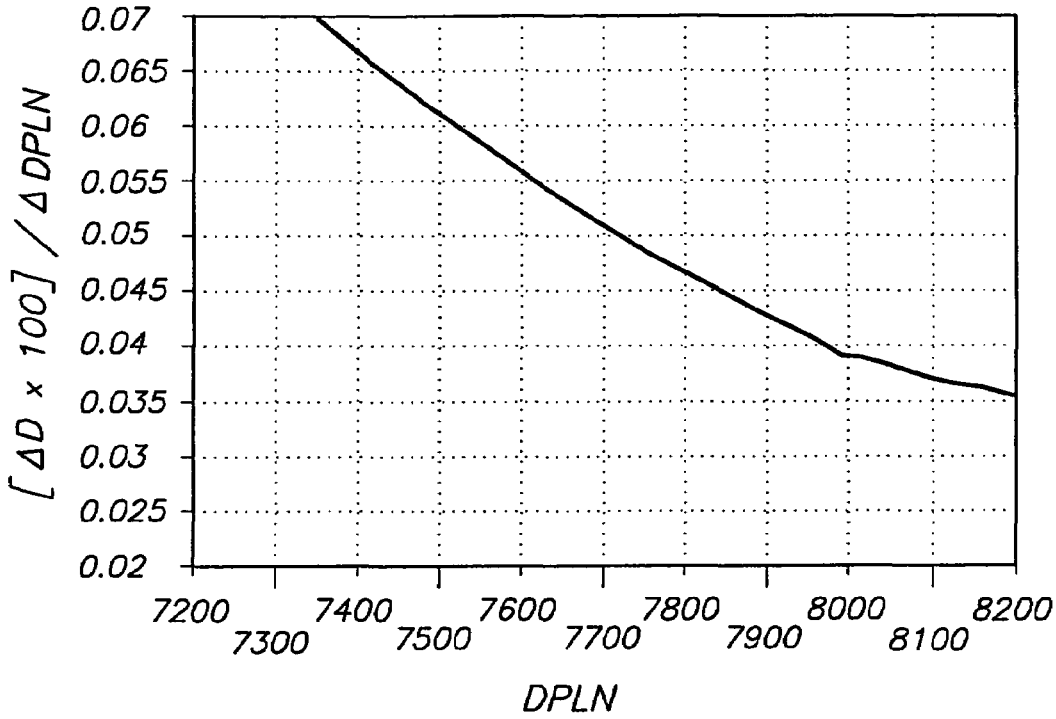
FIG. 6 shows the dependence of the slope of the dependence of print density (D) upon driving power level number (DPLN), ΔD/ΔDPLN, represented by [ΔD×100]/ΔDPLN, upon DPLN for substantially light-insensitive thermographic material type 1 printed with a DRYSTAR 5300 printer with a maximum power of 62.4 mW and a line time of 8.35 ms.
Figure 7:
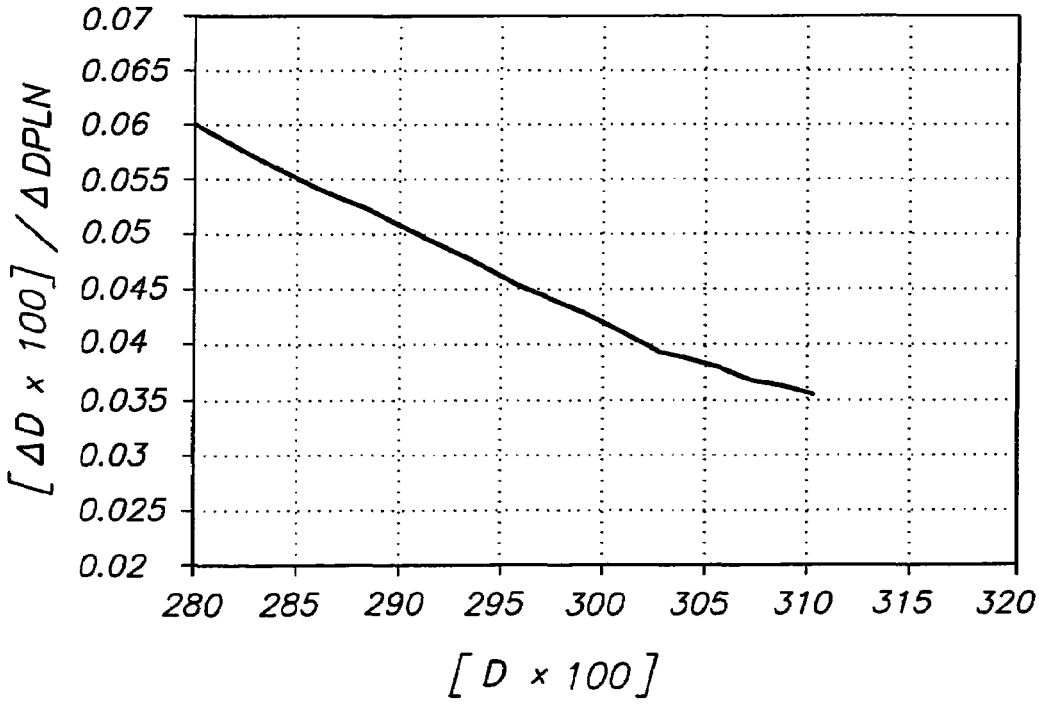
FIG. 7 shows the dependence of the slope of the dependence of print density (D) upon driving power level number (DPLN), ΔD/ΔDPLN, represented by [ΔD×100]/ΔDPLN, upon D, represented by [D×100], for substantially light-insensitive thermographic material type 1 printed with a DRYSTAR 5300 printer with a maximum power of 62.4 mW and a line time of 8.35 ms.

Two step-wedges consisting each of 16 areas, 337 mm in width and ca. 9.5 mm in length along the transport direction of the printer were simultaneously printed on the type 1 substantially light-insensitive thermographic material at a temperature of 25° C. and a relative humidity of 50% with a DRYSTAR™ 5300 printer from AGFA-GEVAERT N.V. with a maximum power level of 62.4 mW and a line time of 8,35 ms. Each of the 32 areas was printed at a different DPLN from a total number of 13 bit (8192) with the 16 areas covering the whole DPLN range. The optical densities were measured with a built-in static transmission densitometer with a spot size of 30×70 mm by taking the average of 13 measurements. The densitometer scanned over the areas in the transport direction while the substantially light-insensitive thermographic material moved to the output tray. The two sets of print density-DPLN data were combined into a single smoothed master curve and the dependence of slope, ΔD/ΔDPLN, represented by [ΔD×100]/ΔDPLN, upon DPLN in shown in FIG. 6. FIG. 7 shows the dependence of the slope, ΔD/ΔDPLN, represented by [ΔD×100]/ΔDPLN, upon optical density D, represented by [D×100].

The initial threshold slope setting of 0.04 gives a maximum density of 302. The threshold slope of this system was decreased to 0.03 in order to achieve a better compromise between Dmax and an acceptable level of thermal print head contamination.

The present invention may include any feature or combination of features disclosed herein either implicitly or explicitly or any generalisation thereof irrespective of whether it relates to the presently claimed invention. In view of the foregoing description it will be evident to a person skilled in the art that various modifications may be made within the scope of the invention.

Having described in detail preferred embodiments of the current invention, it will now be apparent to those skilled in the art that numerous modifications can be made therein without departing from the scope of the invention as defined in the following claims.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Of course, variations of those preferred embodiments will become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

We claim:

1. A thermal head printer with image-invariant printing speeds for printing a substantially light-insensitive thermographic material having a print density-driving power level characteristic, said thermal head printer comprising a means of transporting said substantially light-insensitive thermographic material through said printer having said image invariant printing speeds, one or more thermal heads each having an array of heating elements, a thermal print head drive system capable of supplying power to each of said printing elements, and a means of performing a calibration based on said print density-driving power level characteristic of said thermographic material.

2. The thermal head printer according to claim 1, wherein the maximum driving power applied to said thermographic material during said printing process is adjusted as a function of said print density-driving power level characteristic of said thermographic material.

3. The thermal head printer according to claim 1, wherein said thermal head printer further comprises at least one densitometer capable of measuring the print density of a print produced with said thermal head printer.

4. The thermal head printer according to claim 1, wherein said thermal print head drive system is capable of being calibrated by using the dependence of print density upon power supply level for said substantially light-insensitive thermographic material.

5. A thermal head printer with image-invariant printing speeds for printing a substantially light-insensitive thermographic material having a print density-driving power level characteristic, said thermal head printer comprising a means of transporting said substantially light-insensitive thermographic material through said printer having said image invariant printing speeds, one or more thermal heads each having an array of heating elements, a thermal print head drive system capable of supplying power to each of said printing elements, and a means of performing a calibration based on said print density-driving power level characteristic of said thermographic material, wherein the driving power level in said print density-driving power level characteristic of said thermographic material is rendered dimensionless by normalization.

6. The thermal head printer according to claim 5, wherein the maximum driving power applied to said thermographic material during said printing process is adjusted as a function of said print density-driving power level characteristic of said thermographic material.

7. The thermal head printer according to claim 5, wherein said thermal head printer further comprises at least one densitometer capable of measuring the print density of a print produced with said thermal head printer.

8. The thermal head printer according to claim 5, wherein said thermal print head drive system is capable of being calibrated by using the dependence of print density upon power supply level for said substantially light-insensitive thermographic material.

9. A process for calibrating a thermal head printer with image-invariant printing speeds, said thermal head printer comprising one or more thermal heads each having an array of heating elements connected to a power supply capable of supplying a given number of heating element driving power levels from 0 to a maximum driving power level number, corresponding to $P_{max}$, to each heating element for printing a substantially light-insensitive thermographic material by image-wise heating said thermographic material with said heating elements, said process comprising the steps of:

(i) putting said printer having said image invariant printing speeds into a calibration mode;

(ii) printing one or more step-wedges of print densities by heating said thermographic material with said heating elements at different DPLN's;

(iii) determining the optical density of each step of said step-wedge(s) of print densities with a densitometer thereby obtaining the dependence of said print density upon DPLN;

(iv) deriving from said dependence, or all said dependences of said print density upon DPLN, a single smoothed dependence of the rate of change of print density, D, with DPLN, $\Delta D/\Delta DPLN$, as a function of DPLN for said thermographic material;

(v) establishing a threshold rate of print density change per DPLN for the specific thermographic material being printed with said image invariant printing speeds; and (vi) setting up said thermal head printer so that said threshold rate of print density increase per DPLN cannot be undercut.

10. The process according to claim 9, wherein said one or more step wedges of print densities are printed simultaneously.

11. The process according to claim 9, wherein steps (i) to (iv) are repeated at different places on said thermographic material to obtain further dependencies of said print density upon said heat produced by said heating elements for said thermographic material.

12. A process for printing a substantially light-insensitive thermographic material with a thermal head printer with image-invariant printing speeds, said thermal head printer comprising one or more thermal heads each having an array of heating elements connected to a power supply capable of supplying a given number of heating element driving power levels from 0 to a maximum driving power level number, corresponding to $P_{max}$, said process comprising the steps of: calibrating said thermal head printer, transporting the substantially light-insensitive thermographic material past the thermal head, and image-wise heating of the substantially light-insensitive thermographic material by means of said heating elements, wherein said calibration comprises the steps of:

(i) putting said printer having said image invariant printing speeds into a calibration mode;

(ii) printing one or more step-wedges of print densities by heating said thermographic material with said heating elements at different DPLN's;

(iii) determining the optical density of each step of said step-wedge(s) of print densities with a densitometer thereby obtaining the dependence of said print density upon DPLN;

(iv) deriving from said dependence, or all said dependences of said print density upon DPLN, a single smoothed dependence of the rate of change of print density, D, with DPLN, ΔD/ΔDPLN, as a function of DPLN for said thermographic material;

(v) establishing a threshold rate of print density change per DPLN for the specific thermographic material being printed with said image invariant printing speeds; and (vi) setting up said thermal head printer so that said threshold rate of print density increase per DPLN cannot be undercut.

13. A process for calibrating a thermal head printer with image-invariant printing speeds, said thermal head printer comprising one or more thermal heads each having an array of heating elements connected to a power supply capable of supplying a given number of heating element driving power levels from 0 to a maximum driving power level number, corresponding to $P_{max}$, to each heating element for printing a substantially light-insensitive thermographic material by image-wise heating said thermographic material with said heating elements, said process comprising the steps of:

(i) putting said printer having said image invariant printing speeds into a calibration mode;

(ii) printing one or more step-wedges of print densities by heating said thermographic material with said heating elements at different DPLN's;

(iii) determining the optical density of each step of said step-wedge(s) of print densities with a densitometer thereby obtaining the dependence of said print density upon DPLN;

(iv) deriving from said dependence, or all said dependences of said print density upon DPLN, a single smoothed dependence of the rate of change of print density, D, with DPLN, ΔD/ΔDPLN, as a function of DPLN for said thermographic material;

(v) establishing a threshold rate of print density change per DPLN for the specific thermographic material being printed with said image invariant printing speeds; and (vi) setting up said thermal head printer so that said threshold rate of print density increase per DPLN cannot be undercut, wherein the driving power level in said print density-driving power level characteristic of said thermographic material is rendered dimensionless by normalization.

14. The process according to claim 13, wherein said one or more step wedges of print densities are printed simultaneously.

15. The process according to claim 13, wherein steps (i) to (iv) are repeated at different places on said thermographic material to obtain further dependencies of said print density upon said heat produced by said heating elements for said thermographic material.

16. A process for printing a substantially light-insensitive thermographic material with a thermal head printer with image-invariant printing speeds, said thermal head printer comprising one or more thermal heads each having an array of heating elements connected to a power supply capable of supplying a given number of heating element driving power levels from 0 to a maximum driving power level number, corresponding to $P_{max}$, said process comprising the steps of: calibrating said thermal head printer, transporting the substantially light-insensitive thermographic material past the thermal head, and image-wise heating of the substantially light-insensitive thermographic material by means of said heating elements, wherein said calibration comprises the steps of:

(i) putting said printer having said image invariant printing speeds into a calibration mode;

(ii) printing one or more step-wedges of print densities by heating said thermographic material with said heating elements at different DPLN's;

(iii) determining the optical density of each step of said step-wedge(s) of print densities with a densitometer thereby obtaining the dependence of said print density upon DPLN;

(iv) deriving from said dependence, or all said dependences of said print density upon DPLN, a single smoothed dependence of the rate of change of print density, D, with DPLN, ΔD/ΔDPLN, as a function of DPLN for said thermographic material;

(v) establishing a threshold rate of print density change per DPLN for the specific thermographic material being printed with said image invariant printing speeds; and (vi) setting up said thermal head printer so that said threshold rate of print density increase per DPLN cannot be undercut, wherein the driving power level in said print density-driving power level characteristic of said thermographic material is rendered dimensionless by normalization.

* * * * *